US005548927A

United States Patent [19]

Song

[11] Patent Number: 5,548,927

[45] Date of Patent: Aug. 27, 1996

[54] DOOR OPENING AND CLOSING APPARATUS

[75] Inventor: Kyung-eui Song, Kyungki-do, Rep. of Korea

[73] Assignee: Samsung Electronics Co., Ltd., Suwon, Rep. of Korea

[21] Appl. No.: 317,508

[22] Filed: Oct. 4, 1994

[30] Foreign Application Priority Data

Apr. 29, 1994 [KR] Rep. of Korea ..... 1994-9296

[51] Int. Cl.[6] ..... E05D 15/50

[52] U.S. Cl. ..... 49/193

[58] Field of Search ..... 49/193, 382; 16/231, 16/232, 366, 380, DIG. 23

[56] References Cited

U.S. PATENT DOCUMENTS 4,503,582 3/1985 Gurubatham ..... 49/193 X

FOREIGN PATENT DOCUMENTS 494496 7/1992 European Pat. Off. ..... 49/193
153184 6/1990 Japan ..... 49/193
304185 12/1990 Japan ..... 49/382

*Primary Examiner*—Jerry Redman
*Attorney, Agent, or Firm*—Cushman Darby & Cushman, L.L.P.

[57] ABSTRACT

A door opening and closing apparatus which enables the opening and closing of a door in either direction as desired, and includes hinge shafts which are installed on the left and right sides of a main body to which the door is affixed, left-hand and right-hand hinge accommodation members having shaft receptacles for accommodating the hinge shafts so as to allow the hinge shafts to enter and exit via passages in the accommodation members, and cam plates for mutually interlocking the hinge accommodation members and a connection member for connecting the cam plates with each other, so that when on hinge shaft is released from one hinge accommodation member binds the other hinge shaft.

25 Claims, 8 Drawing Sheets

DOOR OPENING AND CLOSING APPARATUS

BACKGROUND OF THE INVENTION

The present invention relates generally to a door opening and closing apparatus for the opening and closing of a door of a refrigerator or the like, and more particularly, to a door opening and closing apparatus for enabling a door to be opened and closed in either of opposite directions, e.g., swinging to the left or to the right.

Generally, a door for a refrigerator or the like can be opened only from the left or right and then closed by reversing the action. Thus, when purchasing a refrigerator with such a door, the opening/closing direction of the door should be considered in advance to satisfy the ultimate needs or tastes of the user and the installation requirements in view of existing walls or other obstructions which may interfere with the door's operation. Also, when moving and/or reinstalling the refrigerator, there is a considerable limitation with regard to the relocation site. Thus, it is desirable that the refrigerator be equipped with a door which can be opened and closed in either direction.

A conventional apparatus which enables the opening and closing of a door in either of opposite directions is disclosed in U.S. Pat. No. 5,052,151, and is described below with reference to FIGS. 1, 2, 3A and 3B.

With reference now to FIG. 1, there can be seen a refrigerator having a body 2 to which a door 1 is attached. Hinge plates 3 each of which has a hinge shaft 4 are installed at the left and right corners of the upper and lower portions of the front of the refrigerator body 2, respectively. Notches 5 are formed in the door 1 so that each hinge shaft 4 can be engaged with and disengaged from the corresponding notch.

As shown in FIG. 2, an upper fixing plate 6 and a lower fixing plate 8 are mounted to upper and lower inner portions, respectively, of the door 1 in opposed relationship to each other, in correspondence to left and right hinge shafts 4*a* and 4*b* of hinge plates 3*a* and 3*b*. Latch plates 9*a* and 9*b* having latch grooves 10*a* and 10*b* for engaging hinge shafts 4*a* and 4*b*, respectively, are pivotally supported in the left and right sides of the door between the upper fixing plate 6 and the lower fixing plate 8. The respective rotation positions of the latch plates 9*a* and 9*b* are maintained by virtue of the biasing force of springs 11*a* and 11*b*. Pitching links 12*a* and 12*b* and connection link provide a mutual interlocking of latch plates 9*a* and 9*b*. Cover plates 14*a* and 14*b* are pivotally supported so as to cover openings 7*a* and 7*b* of the upper fixing plate 6.

As shown in FIG. 3A, if the door 1 is closed, hinge shafts 4*a* and 4*b* are inserted and locked into openings 7*a* and 7*b* of the upper fixing plate 6 and into latch grooves 10*a* and 10*b* of the latch plates 9*a* and 9*b*, respectively. Also, since springs 11*a* and 11*b* block the rotation of the latch plates 9*a* and 9*b*, the door 1 is maintained in the closed state. If the left side of the door 1 is pulled from the closed state, the latch plate 9*a* is forcibly rotated by the pulling action. Accordingly, the latch groove 10*a* is opened as shown in FIG. 3B. In this case, the altered rotation position of the latch plate 9*a* is maintained by spring 11*a*, and the rotation position of the other latch plate 9*b* is not altered in the door 1, due to the action of the pitching links 12*a* and 12*b* and the connection link 13 in response to the rotation of the latch plate 9*a*. Thus, door 1 pivots on the hinge shaft 4*b* of the other side for opening and closing. The above operation is identical for each side of door 1 due to its symmetrical construction.

In the above-described conventional apparatus, to ensure that the hinge shafts are inserted into and released from the latch grooves with precision and thereby provide for quiet and smooth operation, the rotation positions of the latch plates which are changed in accordance with the opening and closing of the door must be exactly maintained. Thus, the use of the aforementioned springs is required in order to secure the rotation positions of the latch plates. Also, a very small clearance between the working components is required during operation. However, since the cumulative clearance becomes large, particularly due to component wear over time, malfunction is frequent, and since the number of necessary components is great, assembly is complex and inefficient. Moreover, since the latch plate of one side is forcibly rotated in a desired direction when opening and closing the door, a force exceeding that of the spring of the latch plate is required. Thus, when opening and closing the door, strenuous effort is required and the smooth and quiet manipulation thereof is nearly impossible.

SUMMARY OF THE INVENTION

To solve the various prior art problems described above, it is an object of the present invention to provide a door opening and closing apparatus for enabling the opening and closing of a door in either direction, which has a simple construction, increased reliability and which is capable of a high degree of operating precision to enhance user convenience.

It is another object of the present invention to provide a door opening and closing apparatus for enabling smooth and quiet manipulation without strenuous effort.

To accomplish the above objects, there is provided a door opening and closing apparatus including at least two hinge members each of which has a hinge shaft, and which are fixedly installed on the left and right sides of a front portion of a main body to which the door is affixed; at least two hinge accommodation members having shaft receptacles for accommodating the respective shafts in the at least two hinge members and passages for permitting access to the shaft receptacles, and which are pivotally supported in the left and right sides of the door to allow the respective hinge shafts to engage with the shaft receptacles, by expanding and contracting the passage; and facilities for mutually interlocking the at least two hinge members, so that when the hinge shaft of one side is released from one shaft receptacle, the other shaft receptacle mechanically retains the hinge shaft of the other side.

BRIEF DESCRIPTION OF THE DRAWINGS

Further features and advantages of the present invention will become more apparent from the following detailed description, reference being made to the accompanying drawings wherein a preferred embodiment of the present invention is clearly shown. In the drawings.

DETAILED DESCRIPTION OF THE INVENTION

A preferred embodiment of the present invention will be described below with reference to FIGS. 4–8.

Figure 1:
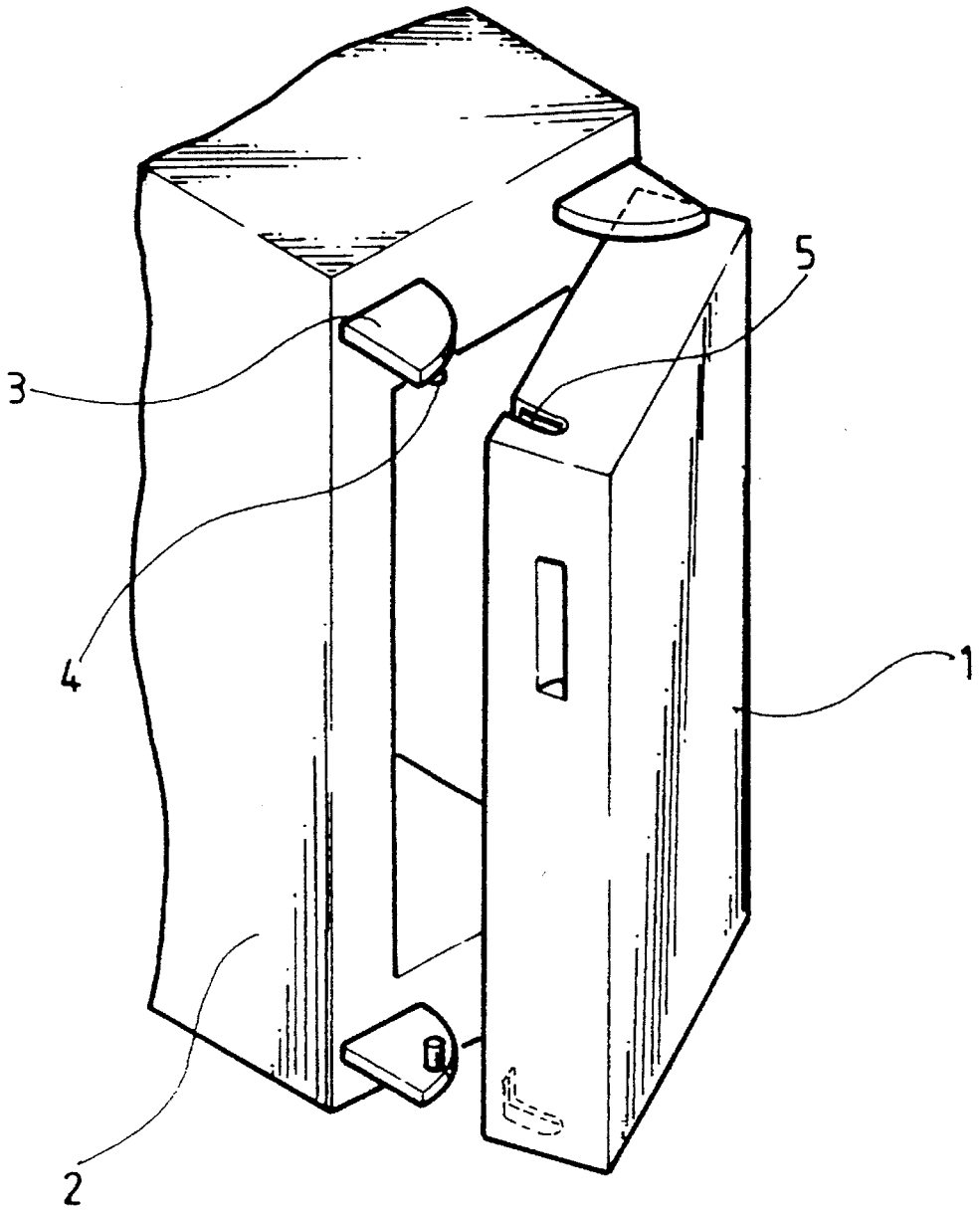
FIG. 1 (PRIOR ART)
FIG. 1 is a perspective view of a refrigerator having a door capable of being bidirectionally opened and closed.
Figure 2:
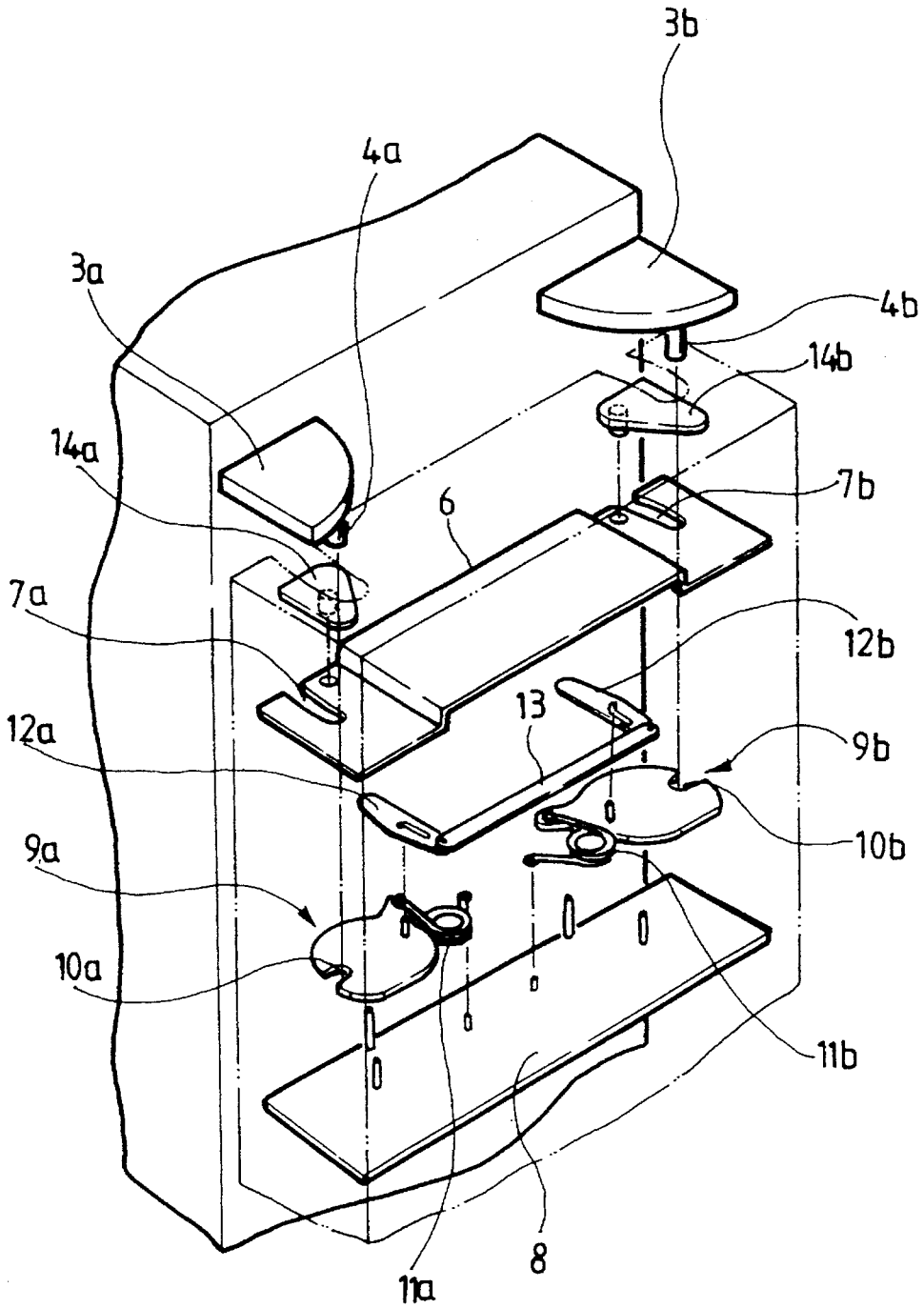
FIG.2 (PRIOR ART)
FIG. 2 is an exploded perspective diagram for explaining constructional elements of a conventional door opening and closing apparatus.
Figure 3A:
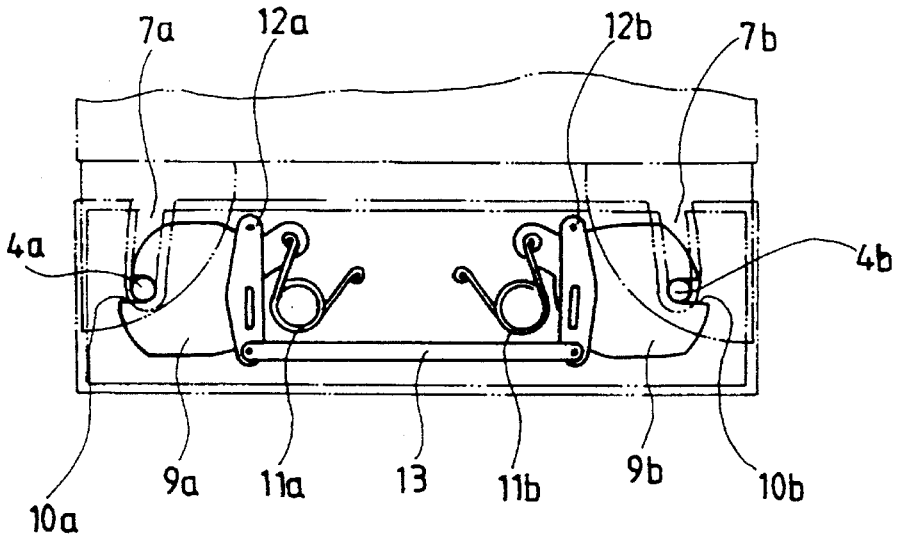
FIG.3A (PRIOR ART)
FIG. 3A is a plan view showing essential elements when the door of the conventional door opening and closing apparatus is in a closed position.
Figure 3B:
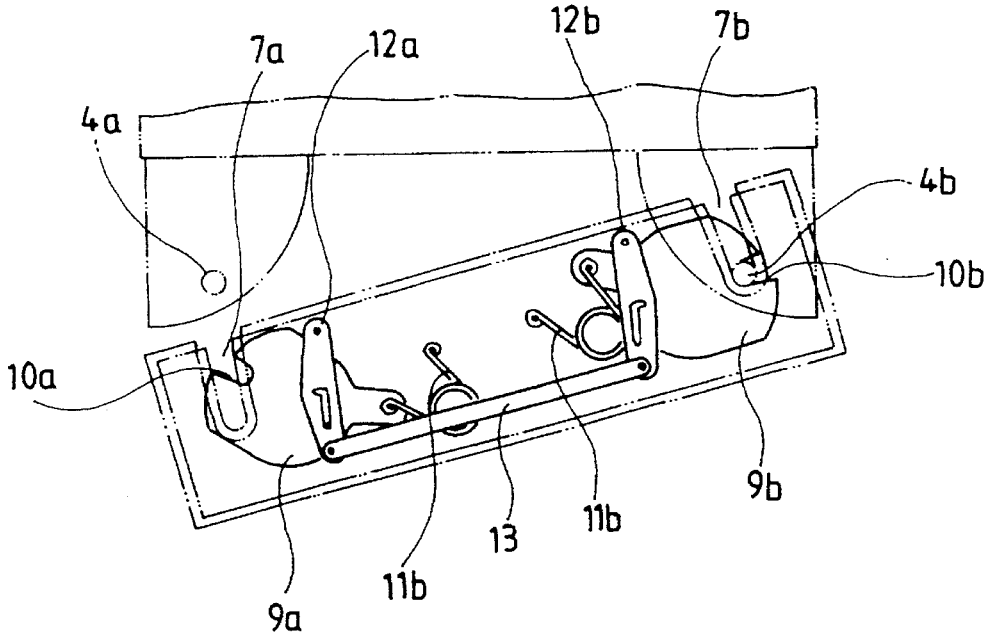
FIG.3B (PRIOR ART)
FIG. 3B is a plan view showing essential elements when the door of the conventional door opening and closing apparatus is in an opened position.
Figure 4:
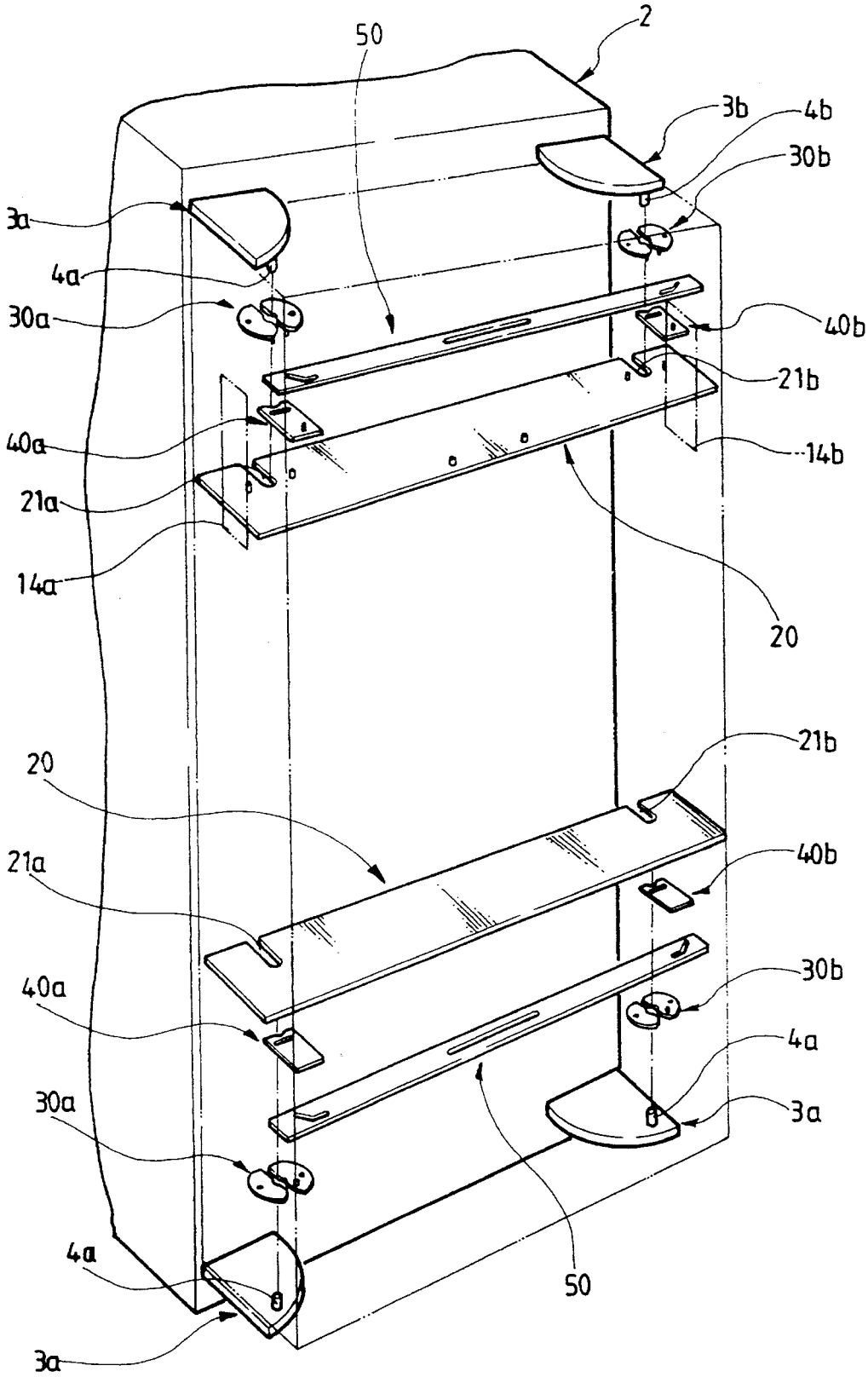
FIG. 4 is an exploded perspective diagram of a door opening and closing apparatus according to a preferred embodiment of the present invention.

With specific reference now to FIG. 4, a door 1 is attached to the front side of a body 2 of a refrigerator. Refrigerator body 2 has hinge plates 3*a* and 3*b* which have hinge shafts 4*a* and 4*b* which are fixedly installed in the left and right corners of the upper and lower portions of the front of refrigerator body 2, respectively. The door 1 has the aforementioned notches (see FIG. 1) and handle grooves 14*a* and 14*b* formed in it's left and right sides thereof, respectively.

Upper and lower fixing plates 20 are fixedly installed inside the door, in correspondence to hinge shafts 4*a* and 4*b*. Two hinge accommodation members 30*a* and 30*b* are supported at the left and right sides of the fixing plates 20. Also, cam plates 40*a* and 40*b* and a connection member 50 are mounted on upper fixing plate 20 as a means for mutually interlocking the hinge accommodation members 30*a* and 30*b*.

Figure 5:
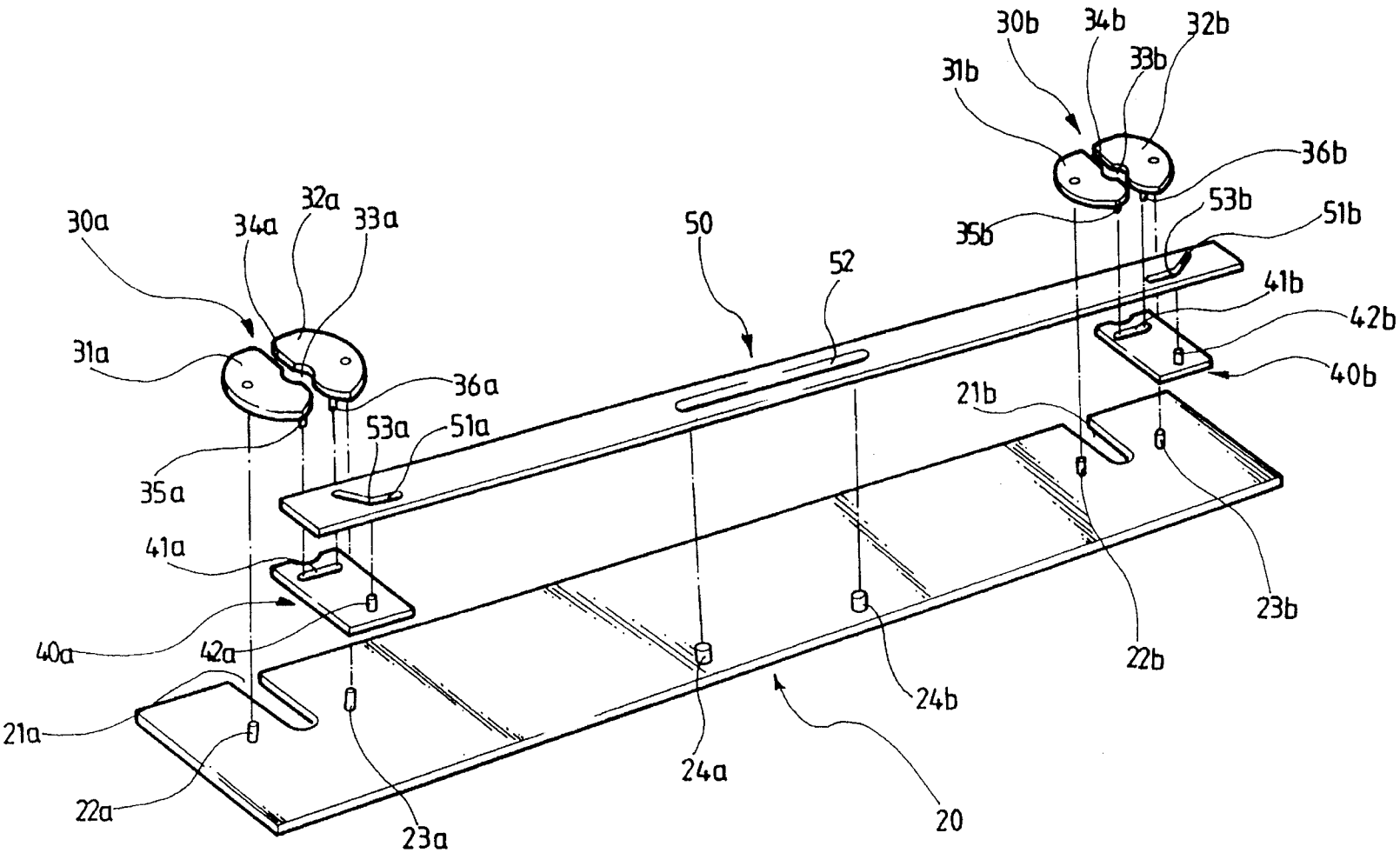
FIG. 5 is an exploded perspective diagram showing the principal elements of the door opening and closing apparatus shown in FIG. 4.

With reference now to FIG. 5, there can be seen the principal components which are disposed in the upper portion the door 1 the lower portion of door 1 is of the same or similar construction.

With continuing reference to FIG. 5, the fixing plate 20 has hinge openings 21*a* and 21*b* with which hinge shafts 4*a* and 4*b* are freely engaged and disengaged. It will be readily appreciated that the fixing plate 20 can be formed as an integral part of the frame (not shown) of the door 1, or securely affixed to the door frame as a separate component. Hinge accommodation members 30*a* and 30*b* are comprised of a pair of semicircular members 31*a* and 32*a* and 31*b* and 32*b*, respectively. Shaft receptacles 33*a* and 33*b* for accommodating the respective hinge shafts 4*a* and 4*b* are formed between the pair of opposing semicircular members 31*a* and 32*a*, and between the pair of opposing semicircular members 31*b* and 32*b*, respectively. Passages 34*a* and 34*b* are provided for facilitating access to the shaft receptacles 33*a* and 33*b*.

The semicircular members 31*a*, 32*a*, 31*b* and 32*b* are supported by pivots 22*a*, 23a, 22*b* and 23*b*, respectively, which are installed adjacent to the left and right sides of the hinge openings 21*a* and 21*b* on the upper fixing plate 20, respectively, and are thus rotatable in the directions of the opening and closing of the door 1. Also, the semicircular members 30*a*, 30*b* have interlocking pins 35*a*, 36*a*, 35*b* and 36*b*, respectively, affixed to the bottom side thereof. Cam plates 40*a* and 40*b* are interposed between the upper fixing plate 20 and the hinge accommodation members 30*a* and 30*b*. The cam plate 40*a* has an interlocking groove 41*a* into which the interlocking pins 35*a* and 36*a* are inserted, and an upstanding cam pin 42*a* which extends from the upper surface thereof. Likewise, the cam plate 40*b* has an interlocking groove 41*b* into which the interlocking pins 35*b* and 36*b* are inserted, and an upstanding cam pin 42*b* which extends from the upper surface thereof. The interlocking grooves 41*a* and 41*b* are preferably made longer than the interval between the interlocking pins 35*a* and 36*a*, and between the interlocking pins 35*b* and 36*b*, respectively, when the passages 34*a* and 34*b* are not open. Cam plates 40*a* and 40*b* are disposed so as to be slidably movable, either forward or backward, by interlocking pins 35*a*, 36*a*, and 35*b* and 36*b*, respectively, in response to movement of the semicircular members 31*a*, 32*a*, and 31*b* and 32*b* of the hinge accommodation members 30*a* and 30*b* respectively, which rotate about the pivots 22*a*, 23*a*, and 22*b* and 23*b* respectively.

A connection member 50 has cam grooves 51*a* and 51*b* which are formed adjacent to the left and right ends thereof respectively, and a guide opening 52 formed lengthwise along its central, longitudinal axis. Guide pins 24*a* and 24*b* extending from the upper fixing plate 20 are inserted into the guide opening 52. Thus, connection member 50 is slidably supported lengthwise in guide opening 52. That is, the movement of the connection member 50 is limited by both ends of the guide opening 52, which physically limit the movement of guide pins 24*a* and 24*b*. The cam grooves 51*a* and 51*b*, in connection member 50, are comprised of a slanted portion and a horizontal portion in open communication with each other, which have been designed so that the cam pins 42*a* and 42*b* in the cam plates 40*a* and 40*b* are positioned at the vertex portions 53*a* and 53*b* between the slanted portion and the horizontal portion when the door 1 is in a closed position, as shown in FIG. 6.

It will be readily appreciated that the hinge plates 3*a* and 3*b*, having hinge shafts 4*a* and 4*b*, can be formed as an integral part of the frame (not shown) of the door 1, or securely affixed to the door frame as separate components, and the elements shown in FIG. 5 can be formed as an integral part of the refrigerator body 2 or securely affixed thereto as separate components.

Figure 6:
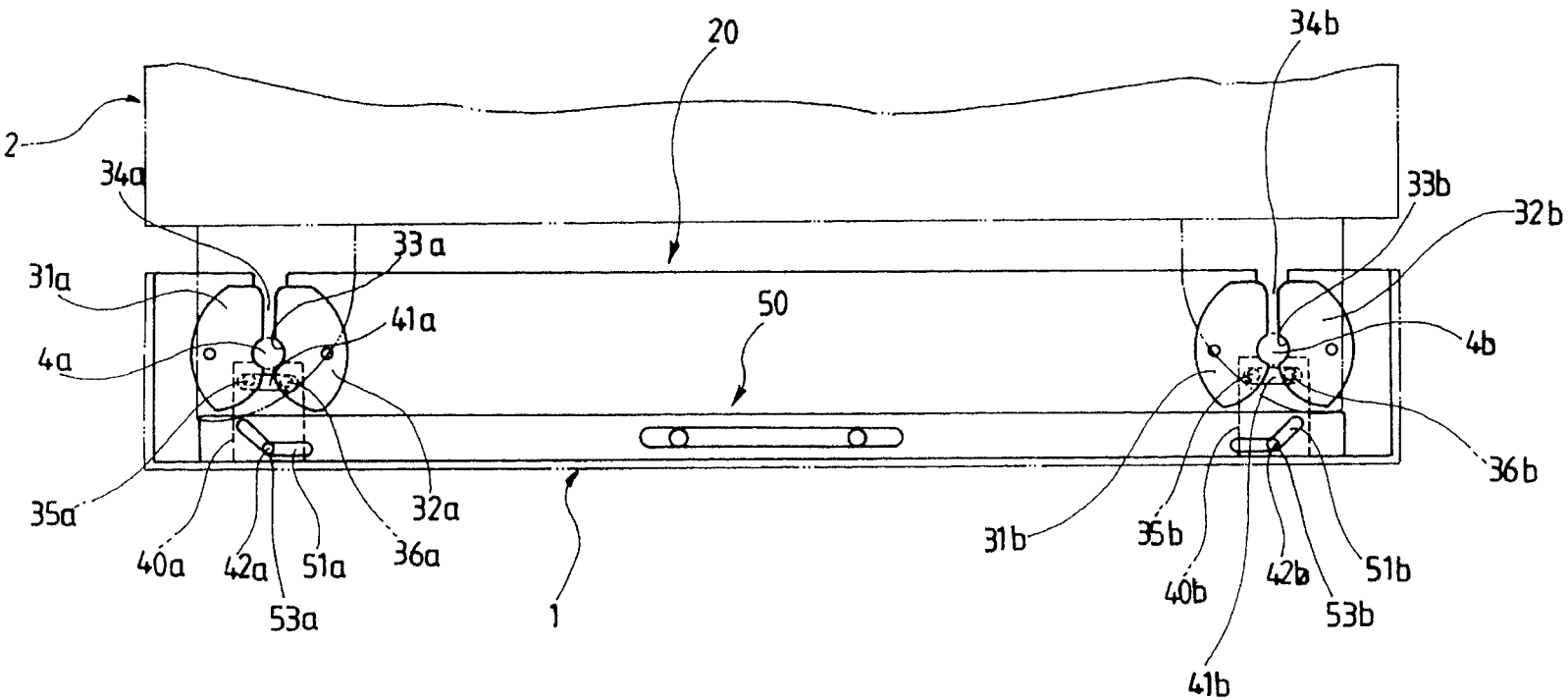
FIG. 6 is a plan view of the door opening and closing apparatus shown in FIG. 4, when the door is in a closed position.
Figure 7:
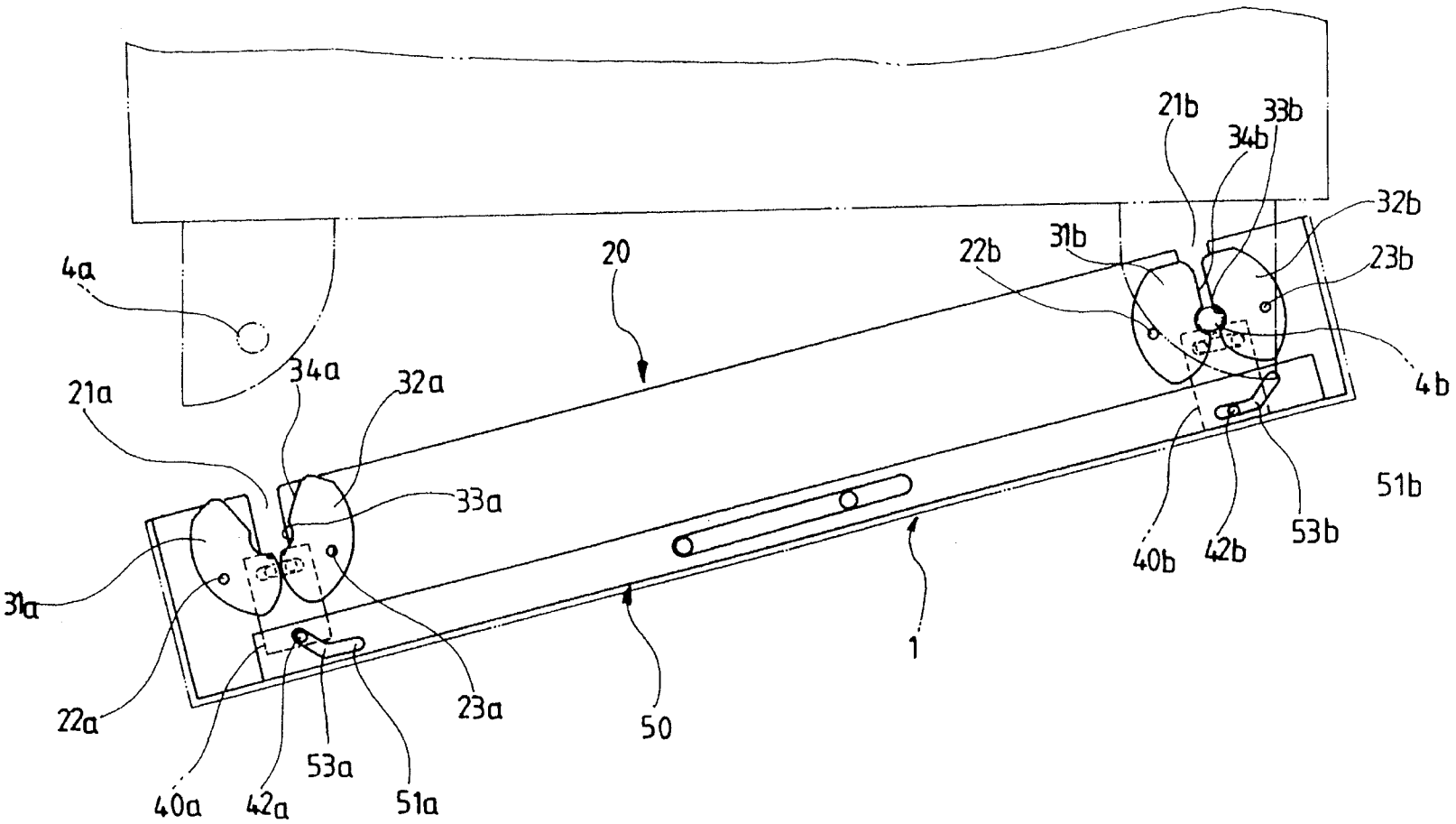
FIG. 7 is a plan view of the door opening and closing apparatus shown in FIG. 4, when the door is in a first opened state.
Figure 8:
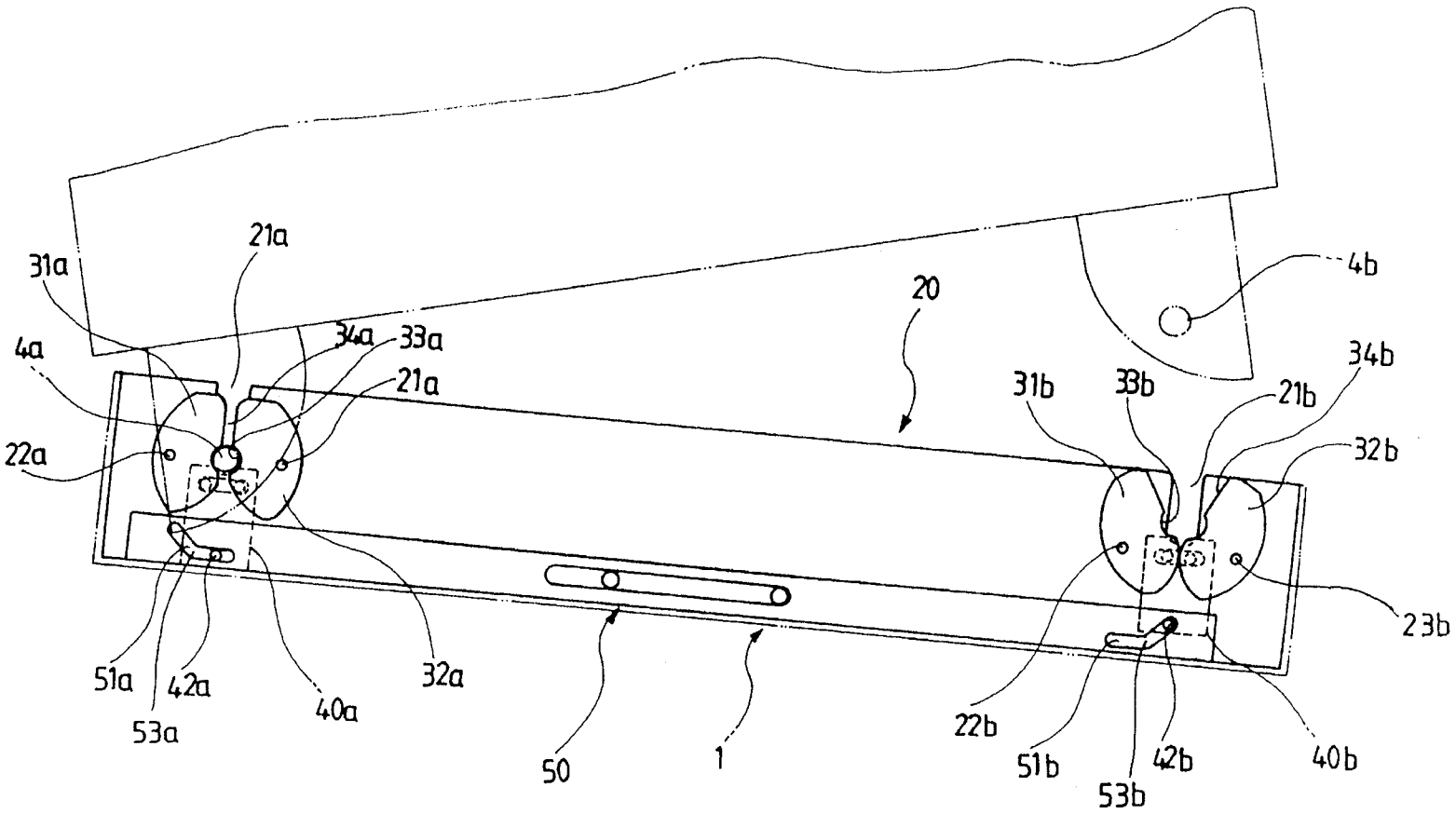
FIG. 8 is a plan view of the door opening and closing apparatus shown in FIG. 4, when the door is in a second opened state.

With reference to FIGS. 6, 7 and 8, the operation of the above-described preferred embodiment of the door opening and closing apparatus of the present invention will now be described.

FIG. 6 shows a closed state of the door opening and closing apparatus in which the door 1 is in a closed position. Since the cam pins 42*a* and 42*b* in the cam plates 40*a* and 40*b* are located at the vertex portions 53*a* and 53*b* between the slanted and the horizontal portions of the cam grooves 51*a* and 51*b*, the cam plates 40*a* and 40*b* cannot be arbitrarily moved. Also, since the interlocking pins 35*a*, 36*a*, and 35*b* and 36*b* are held in the interlocking grooves 41*a* and 41*b* in the cam plates 40*a* and 40*b*, the semicircular members 31*a*, 32*a*, 31*b* and 32*b*, respectively, cannot be rotated arbitrarily. Thus, the hinge shafts 4*a* and 4*b* are securely held in the shaft receptacles 33*a* and 33*b* in the hinge accommodation members 30*a* and 30*b*, thereby maintaining the door 1 in a closed state.

In the closed state of FIG. 6, if the left side of door 1 is pulled, the hinge shaft 4*a* is forcibly released from the shaft receptacle 33*a* in the left-side hinge accommodation member 30*a* via the passage 34*a*. As shown in FIG. 7, the semicircular members 31*a* and 32*a* of the hinge accommodation member 30*a* pivot on respective pivots 22*a* and 23*a* so that the passage 34*a* is spread wider, and the cam plate 40*a* is pulled by the interlocking pins 35*a* and 36*a* of the semicircular members 31*a* and 32*a* in the opposite direction to the movement of door 1. When the cam plate 40*a* is pulled, the cam pin 42*a* is moved into the slanted portion of the cam groove 51*a* of the connection member 50, to thereby shift the connection member 50 from the left to the right. When the connection member 50 is moved from the left to the right, the cam pin 42*b* is moved into the horizontal portion of the cam groove 51*b*, thereby blocking the right-side cam plate 40*b* from forward and backward movement. Finally, the semicircular members 31*b* and 32*b* in the right-side hinge accommodation member 30*b* are in the state in which the passage 34*b* is not parted, whereby the right-side hinge shaft 4*b* is retained in the shaft receptacle 33*b*.

If the left side of the door 1 is pushed to be closed from the state shown in FIG. 7, the hinge shaft 4*a* in the refrigerator body 2 is inserted into the left-side hinge opening 21*a* in the upper fixing plate 20, to thereby part passage 34*a* in hinge accommodation member 30*a*, thereby enabling the hinge shaft 4*a* to enter the shaft receptacle 33*a*, which forces the semicircular members 31*a* and 32*a* of the hinge accommodation member 30*a* to rotate back to their original positions. Cam plate 40*a* is pushed out by the interlocking pins 35*a* and 36*a* of the semicircular members 31*a* and 32*a*, whereby the connection plate 50 is forcibly moved from the right to the left by the cam pin 42*a* of the cam plate 40*a*, thus returning the door opening and closing apparatus to its closed state shown in FIG. 6.

FIG. 8 shows the state of the door opening and closing apparatus after being pulled open from the right side of the door 1. In this case, the right-side hinge shaft 4*b* is released from the opened shaft receptacle 33*b* via the parted passage 34*b*, and the left-side hinge shaft 4*a* is held in the shaft receptacle 33*a* in the hinge accommodation member 30*a*. Since the operation of opening the door 1 from the right side is performed symmetrically with that of the above-described operation performed when the door 1 is opened from the left side, a detailed description of this operation has been omitted. In general, when the door is pulled from one side to be opened, it can be said that that side of the door opening and closing apparatus is in a "first" state (opened) and the other side thereof is in a "second" state (unopened), and vice versa.

As described above, the door opening and closing apparatus according to the present invention uses left-hand and right-hand hinge accommodation members each having a pair of semicircular members which are pivotally supported. Accordingly, the hinge accommodation member of one side releases the hinge shaft of that side, and the hinge accommodation member of the other side binds the hinge shaft of that side so as to prevent its release therefrom, according to the door opening direction, thereby enabling the opening and closing the door in either direction as desired. With the door opening and closing apparatus according to the present invention, since the position of the shaft receptacle in the hinge accommodation member is not varied, irrespective of the opening and closing of the door, the springs required in the prior art door opening and closing are not necessary for smooth and reliable operation. Additionally, the number of elements is reduced to facilitate easier and more efficient assembly, and further, malfunction is minimized due to the improved clearance between the elements, thereby increasing reliability. Additionally, the door can be smoothly and quietly opened and closed without strenuous effort, from either direction.

Although the present invention has been described in detail hereinabove, it should be clearly understood that many variations and/or modifications of the basic inventive concepts taught herein which may appear to those skilled in the pertinent art will fall within the spirit and scope of the present invention, as defined in the appended claims. For example, although the present invention has been described in terms of opening and closing a refrigerator door, it will be readily appreciated by those skilled in the art that the apparatus of the present invention can be similarly used for opening a door of any other appliance, piece of furniture or the like. Further, the apparatus of the present invention may be utilized to open a door from either of the top and bottom sides of a main body, rather than from either of the left and right sides of the main body.

What is claimed is:

1. A door opening and closing apparatus for opening and closing a door mounted on a main body from either of opposite first and second sides thereof, said apparatus comprising:

a first hinge member having a hinge shaft, said first hinge member being securely fixed to said main body of said first side;

a second hinge member having a hinge shaft, said second hinge member being securely fixed to said main body on said second side;

a first hinge accommodation member having a shaft receptacle for releasably retaining said hinge shaft of said first hinge member, and a shaft passage for facilitating access of said hinge shaft of said first hinge member to and from said shaft receptacle of said first hinge accommodation member, said first hinge accommodation member being pivotally supported on said first side for movement from a closed position said shaft passage thereof is of a first dimension and wherein said shaft receptacle thereof securely retains said hinge shaft of said first hinge member, and an open position wherein said shaft passage thereof is of a second dimension greater than that of the first dimension said hinge shaft of said first hinge member is released from said shaft receptacle thereof;

a second hinge accommodation member having a shaft receptacle for releasably retaining said hinge shaft of said second hinge member, and a shaft passage for facilitating access of said hinge shaft of said second hinge member to and from said shaft receptacle of said second hinge accommodation member, said second hinge accommodation member being pivotally supported on said second side for movement from a closed position wherein said shaft passage thereof is a first dimension and said shaft receptacle thereof securely retains said hinge shaft of said second hinge member, and an open position wherein said shaft passage thereof is of a second dimension greater than that of the first dimension said hinge shaft of said second hinge member is released from said shaft receptacle thereof; and, facilities for interconnecting and mutually interlocking said first and second hinge accommodation members so that when said first hinge accommodation member is in said open position, said second hinge accommodation member is in said closed position, and vice versa.

2. The apparatus as set forth in claim 1, wherein:

said first hinge member comprises a hinge plate which carries said hinge shaft of said first hinge member; and, said second hinge member comprises a hinge plate which carries said hinge shaft of said second hinge member.

3. The apparatus as set forth in claim 1, wherein:

said first hinge accommodation member includes a pair of opposed members which together form said shaft receptacle and said shaft passage of said first hinge accommodation member; and, said second hinge accommodation member includes a pair of opposed members which together form said shaft receptacle and said shaft passage of said second hinge accommodation member.

4. The apparatus as set forth in claim 3, wherein said pair of opposed members of each of said first and second hinge accommodation members are of generally semicircular shape.

5. The apparatus as set forth in claim 2, wherein:

said first hinge accommodation member includes a pair of opposed members which together form said shaft receptacle and said shaft passage of said first hinge accommodation member; and, said second hinge accommodation member includes a pair of opposed members which together form said shaft receptacle and said shaft passage of said second hinge accommodation member.

6. The apparatus as set forth in claim 1, wherein said interconnecting facilities comprise:

a first cam plate having an interlocking groove;

at least one first interlocking pin carried by said first hinge accommodation member and inserted within said interlocking groove of said first cam plate;

a second cam plate having an interlocking groove;

at least one second interlocking pin carried by said second hinge accommodation member and inserted within said interlocking groove of said second cam plate;

wherein said first cam plate is movable in a direction generally away from said main body in response to movement of said first hinge accommodation member from said closed position to said open position, and movable in a direction generally towards said main body in response to movement of said first hinge accommodation member from said open position to said closed position;

wherein said second cam plate is movable in a direction generally away from said main body in response to movement of said second hinge accommodation member from said closed position to said open position, and movable in a direction generally towards said main body in response to movement of said second hinge accommodation member from said open position to said closed position; and, connection facilities for interlocking said first and second cam plates so that when said first cam plate is moved, movement of said second cam plate is blocked, and vice versa.

7. The apparatus as set forth in claim 6, wherein said connection facilities comprise:

a first cam pin carried by said first cam plate;

a second cam pin carried by said second cam plate; and, a connection member having a first cam engaging groove disposed generally adjacent to said first side and a second cam engaging groove disposed generally adjacent to said second side, wherein said first cam pin is inserted in said first cam engaging groove and said second cam pin is inserted in said second cam engaging groove.

8. The apparatus as set forth in claim 7, wherein said first and second cam engaging grooves each include a horizontal portion disposed generally parallel to said main body when the door is in a closed position, and a slanted portion joining said horizontal portion and extending generally diagonally from said horizontal portion in a direction generally towards said main body when the door in said closed position.

9. The apparatus as set forth in claim 8, wherein said first cam pin rests in said first cam engaging groove at a vertex thereof located at a juncture between said horizontal and slanted portions thereof when the door is in said closed position, and said second cam pin rests in said second cam engaging groove at a vertex thereof located at a juncture between said horizontal and slanted portions thereof when the door is in said closed position.

10. The apparatus as set forth in claim 9, wherein:

said connection member is moved in a direction from said first side towards said second side by said first cam pin when said first accommodation member is moved from its said closed position to its said open position, by virtue of said first cam pin travelling in said slanted portion of said first cam engaging groove; and, said connection member is moved in a direction from said second side towards said first side by said first cam pin when said first accommodation member is moved from its said closed position to its said open position, by virtue of said first cam pin travelling in said slanted portion of said first cam engaging groove.

11. The apparatus as set forth in claim 10, wherein:

said connection member is moved in a direction from said second side towards said first side by said second cam pin when said second accommodation member is moved from its said closed position to its said open position, by virtue of said second cam pin travelling in said slanted portion of said second cam engaging groove; and, said connection member is moved in a direction from said first side towards said second side by said second cam pin when said second accommodation member is moved from its said closed position to its said open position, by virtue of said second cam pin travelling in said slanted portion of said second cam engaging groove.

12. The apparatus as set forth in claim 11, wherein:

when said first cam pin travels in said slanted portion of said first cam engaging groove, said second cam pin travels in said horizontal portion of said second cam engaging groove, to thereby prevent movement of said second hinge accommodation member; and, when said second cam member travels in said slanted portion of said second cam engaging groove, said first cam pin travels in said horizontal portion of said first cam engaging groove, to thereby prevent movement of said first hinge accommodation member.

13. The apparatus as set forth in claim 12, further comprising at least one support member for supporting said first and second hinge accommodation members, said first and second cam plates, and said connection member.

14. The apparatus as set forth in claim 13, wherein:

said connection member further includes a pin travel limit groove disposed intermediate said first and second sides;

said at least one support member includes first and second spaced-apart upstanding pins disposed intermediate said first and second sides and inserted in said pin travel limit groove of said connection member; and, wherein said first and second upstanding pins and said pin travel limit groove cooperate to limit movement of said connection member from said first side towards said second side and vice versa.

15. The apparatus as set forth in claim 14, wherein:

said first hinge member comprises a hinge plate which carries said hinge shaft of said first hinge member; and, said second hinge member comprises a hinge plate which carries said hinge shaft of said second hinge member.

16. The apparatus as set forth in claim 15, wherein:

said first hinge accommodation member includes a pair of opposed members which together form said shaft receptacle and said shaft passage of said first hinge accommodation member; and, said second hinge accommodation member includes a pair of opposed members which together form said shaft receptacle and said shaft passage of said second hinge accommodation member.

17. The apparatus as set forth in claim 16, wherein each of said opposed members of each of said first and second hinge accommodation members is generally semicircular shape.

18. The apparatus as set forth in claim 16, wherein said support member further includes:

a first hinge pin for pivotally supporting a first one of said pair of opposed members of said first hinge accommodation member;

a second hinge pin for pivotally supporting a second one of said opposed members of said first hinge accommodation member;

a third hinge pin for pivotally supporting a first one of said opposed members of said second hinge accommodation member; and, a fourth hinge pin for pivotally supporting a second one of said opposed members of said second hinge accommodation member.

19. The apparatus as set forth in claim 18, wherein said support member further includes:

a first opening for accommodating movement of said hinge shaft of said first hinge member; and, a second opening for accommodating movement of said hinge shaft of said second hinge member.

20. The apparatus as set forth in claim 1, wherein the door is a refrigerator door.

21. A door opening and closing apparatus for opening and closing a door mounted on a main body from either of opposite first and second sides thereof, said apparatus comprising:

hinge means for respectively and rotatably supporting both sides of said door, said hinge means including at least two hinge members each of which has a hinge shaft, wherein at least one hinge member is fixedly installed on the first and second sides of said main body, respectively;

hinge accommodation means for releasably retaining said hinge shafts, said hinge accommodation means including at least two hinge accommodation members each of which is movably installed on said door and has a shaft receptacle for accommodating said hinge shaft corresponding to said shaft receptacle and a shaft passage for gaining access to the shaft receptacle corresponding to said hinge shaft, wherein said at least hinge accommodation members are located in correspondence to said at least two hinge members and are pivotally supported in the first and second sides of said door to allow the respective hinge shafts to engage with the shaft receptacles, by expanding and contracting said passages; and interlocking means for mutually interlocking said hinge accommodation means, so that when said door is in a closed position, said shaft passages of said at least two hinge accommodation members which are located in the first and second sides of said door are narrowed while when said door is in an open position, each of said shaft passages of said at least two hinge accommodation members in one side of said door is in a widened state, and each of said shaft passages of said hinge accommodation members in the other side of said door is in a narrowed state, respectively.

22. A door opening and closing apparatus according to claim 21, wherein each of said at least two hinge members comprises a hinge plate on which said hinge shaft is fixedly mounted.

23. A door opening and closing apparatus according to claim 21, wherein each of said at least two hinge accommodation members comprises a pair of opposing members for forming said shaft receptacles and said passages in said at least two hinge accommodation members and which are pivotally and rotatably supported so as to narrow and widen said passages.

24. A door opening and closing apparatus according to claim 23, wherein each of said opposing members is semicircular.

25. A door opening and closing apparatus according to claim 21, wherein said interlocking means comprises:

interlocking pins respectively installed in said at least two hinge accommodation members;

two cam plates which have interlocking grooves into which said interlocking pins are inserted, and which are movable forward and backward to interlock with said interlocking pins which are moved according to rotation of said two hinge accommodation members; and a connection member for interlocking said two cam plates so that, when one cam plate is withdrawn, movement of the other cam plate is blocked.

* * * * *